US008998075B1

(12) United States Patent
Merriweather

(10) Patent No.: US 8,998,075 B1
(45) Date of Patent: Apr. 7, 2015

(54) GAMBLING RISK MANAGEMENT DEVICE

(71) Applicant: Kim L. Merriweather, Southfield, MI (US)

(72) Inventor: Kim L. Merriweather, Southfield, MI (US)

( * ) Notice: Subject to any disclaimer, the term of this patent is extended or adjusted under 35 U.S.C. 154(b) by 0 days.

(21) Appl. No.: 14/079,765

(22) Filed: Nov. 14, 2013

(51) Int. Cl.
*E05G 1/00* (2006.01)
*E05G 1/06* (2006.01)

(52) U.S. Cl.
CPC . *E05G 1/005* (2013.01); *E05G 1/06* (2013.01)

(58) Field of Classification Search
CPC ..... E05G 1/005; E05G 1/026; E05G 1/06; E05G 1/08; A45C 1/12; A45C 2001/006; A45C 2001/065; A45C 2001/083
USPC ..... 232/1 D, 43.1, 43.4, 44; 206/37; 109/23, 109/53, 56; 150/138, 143, 149; 70/63, 159
See application file for complete search history.

(56) References Cited

U.S. PATENT DOCUMENTS 4,202,445 A 5/1980 Porter
4,853,676 A 8/1989 Kitts
5,598,792 A 2/1997 Wales
D409,229 S 5/1999 Matsubara et al.
5,918,554 A 7/1999 Rassamni
6,374,757 B1 4/2002 Farkash
6,490,893 B1 12/2002 Benion
8,408,147 B2 4/2013 Holloway et al.
8,667,998 B1 * 3/2014 Westrick ..... 150/147
2002/0170473 A1 11/2002 Fettis et al.

* cited by examiner

*Primary Examiner* — William Miller

(57) ABSTRACT

A gambling risk management device restricts access to financial resources while in a gambling facility to prevent risking financial resources beyond an initial selected limit. The device includes a container and a bottom door selectively closing a bottom opening into the container. A lock selectively secures the bottom door in a closed position. A bill compartment and a card compartment are each positioned in the container. A bill opening is positioned at a top of the bill compartment. The bill opening permits passing a bill through the bill opening into the bill compartment and restricts removal of the bill from the bill compartment. A card opening is positioned at a top of the card compartment. The card opening permits passing a card through the card opening into the card compartment and restricts removal of the card from the card compartment through the card opening.

8 Claims, 4 Drawing Sheets

GAMBLING RISK MANAGEMENT DEVICE

BACKGROUND OF THE DISCLOSURE

Field of the Disclosure

The disclosure relates to risk management devices and more particularly pertains to a new risk management device for restricting access to financial resources while in a gambling facility to prevent risking financial resources beyond an initial selected limit.

SUMMARY OF THE DISCLOSURE

An embodiment of the disclosure meets the needs presented above by generally comprising a container and a bottom door selectively closing a bottom opening into the container. A lock selectively secures the bottom door in a closed position. A bill compartment and a card compartment are each positioned in the container. A bill opening is positioned at a top of the bill compartment. The bill opening permits passing a bill through the bill opening into the bill compartment and restricts removal of the bill from the bill compartment. A card opening is positioned at a top of the card compartment. The card opening permits passing a card through the card opening into the card compartment and restricts removal of the card from the card compartment through the card opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
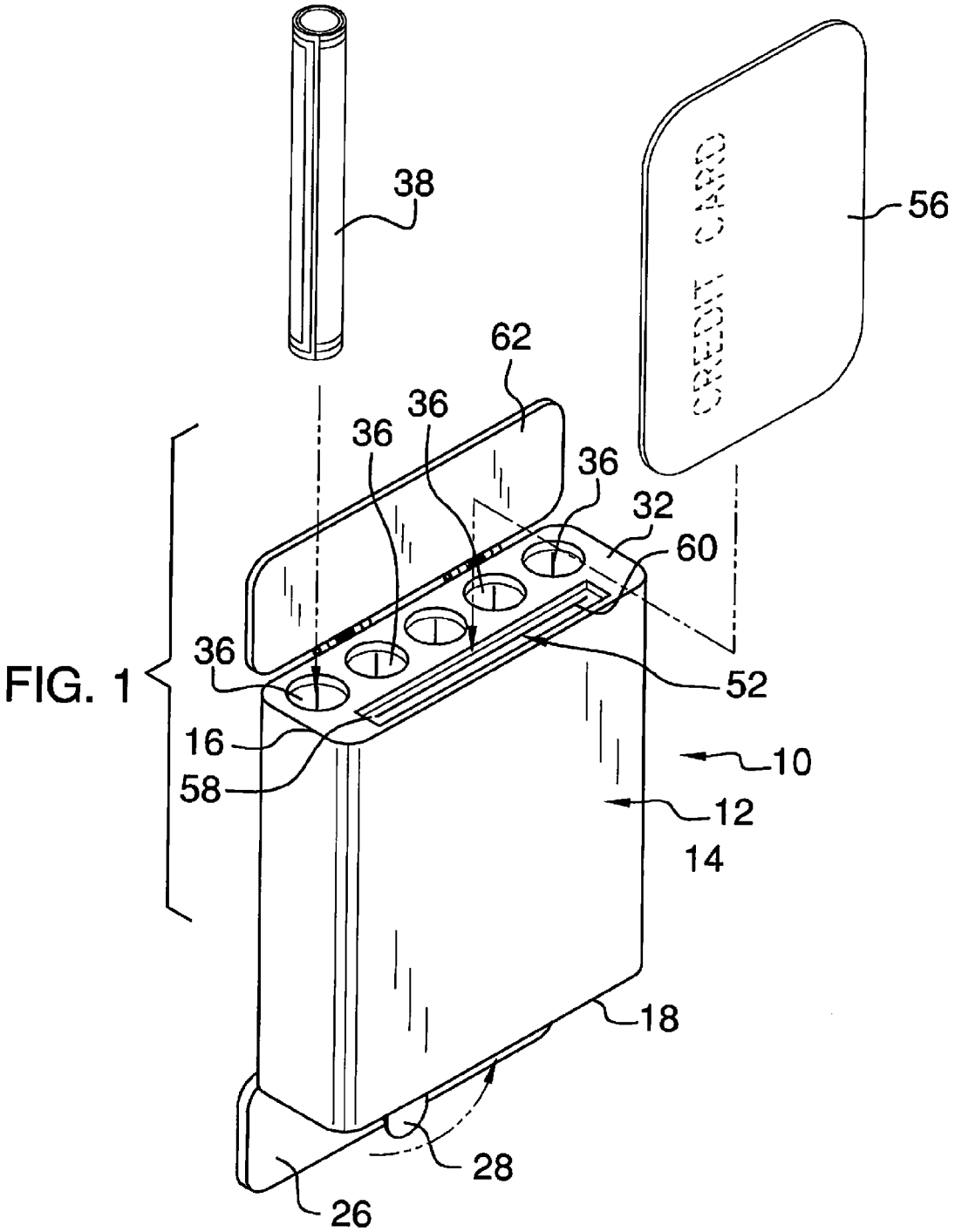
FIG. 1 is a top front side perspective view of a gambling risk management device according to an embodiment of the disclosure.
Figure 2:
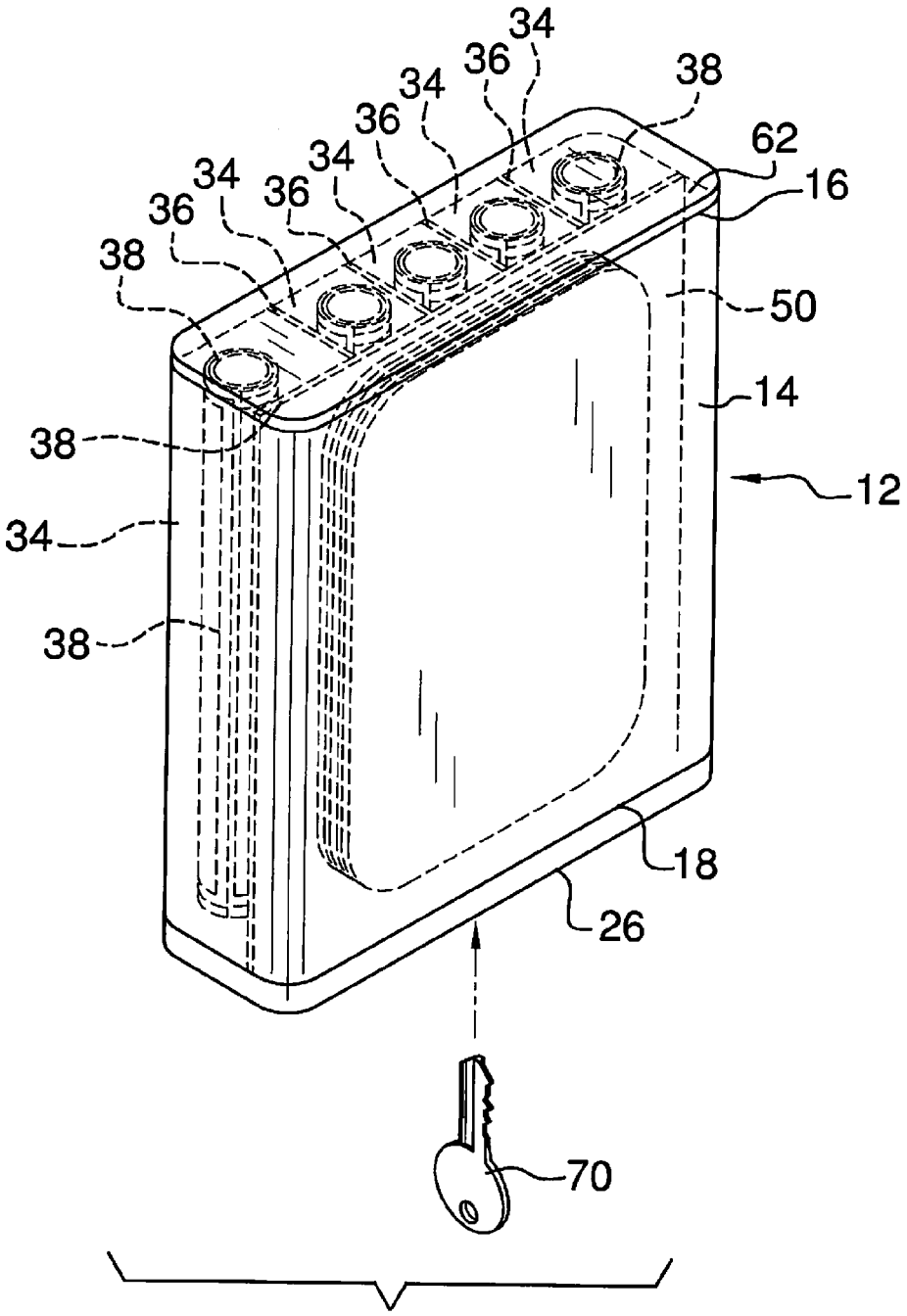
FIG. 2 is a top front side perspective view of an embodiment of the disclosure in a closed position.
Figure 3:
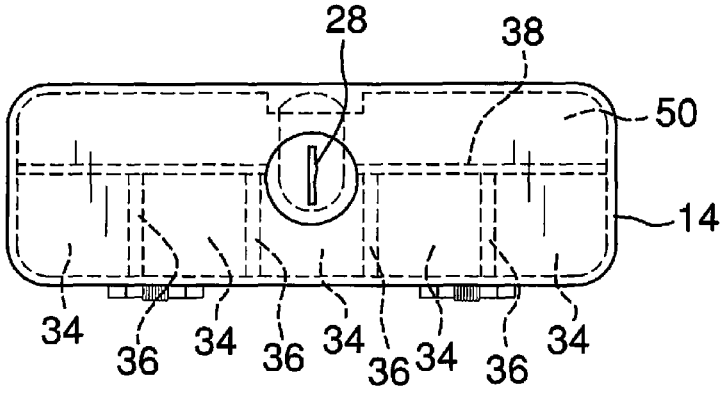
FIG. 3 is a bottom view of an embodiment of the disclosure.
Figure 4:
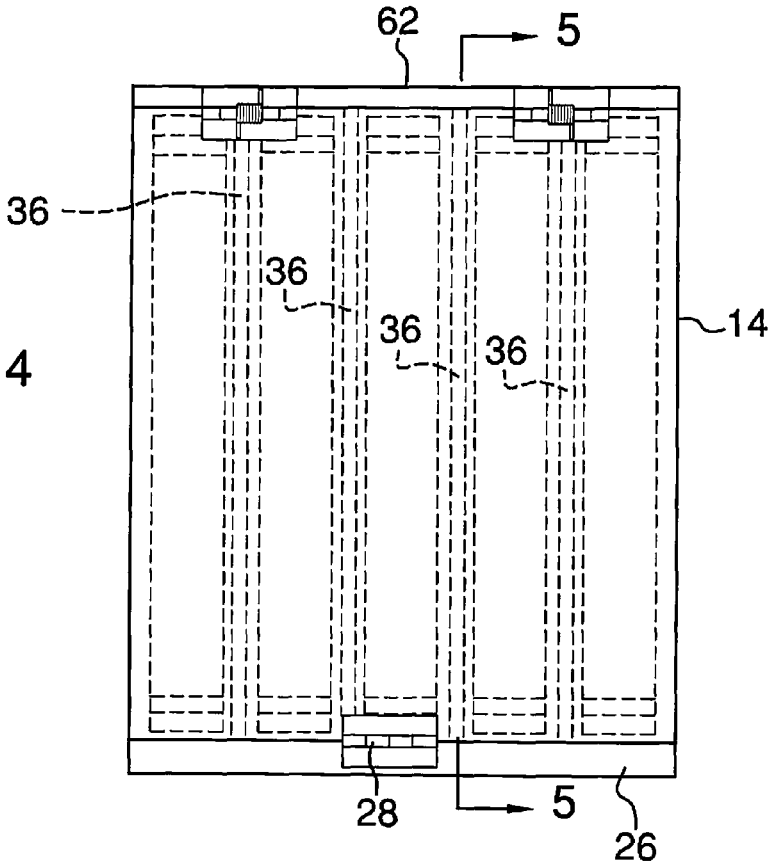
FIG. 4 is a back view of an embodiment of the disclosure.
Figure 5:
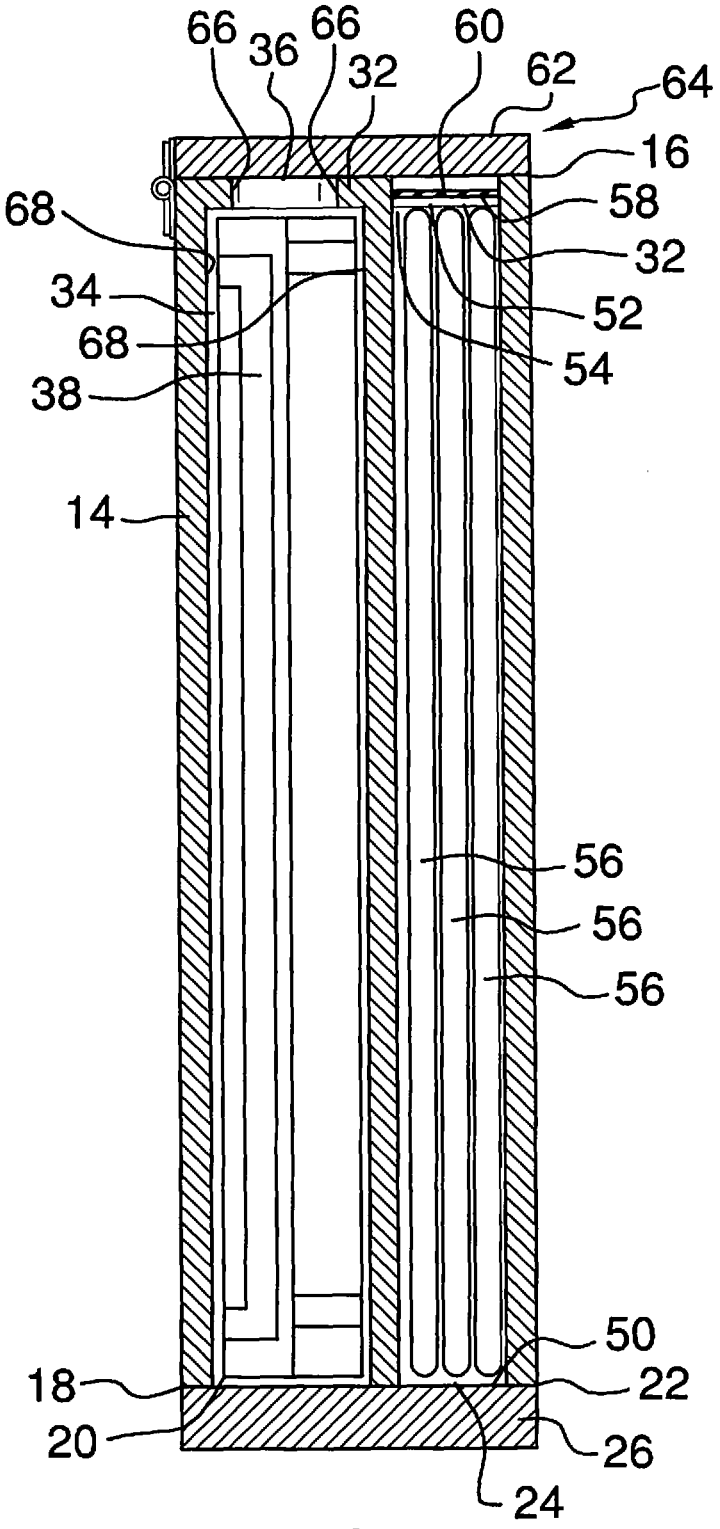
FIG. 5 is a cross-sectional view of an embodiment of the disclosure taken along line 5-5 of FIG. 4.

With reference now to the drawings, and in particular to FIGS. 1 through 5 thereof, a new risk management device embodying the principles and concepts of an embodiment of the disclosure and generally designated by the reference numeral 10 will be described.

As best illustrated in FIGS. 1 through 5, the gambling risk management device 10 generally comprises a container 12 having a perimeter wall 14 extending between a top end 16 and a bottom end 18 of the container 12. The perimeter wall 14 defines an interior space 20 of the container 12. A bottom edge 22 of the perimeter wall 14 defines a bottom opening 24 into the interior space 20. A bottom door 26 is pivotally coupled to the perimeter wall 14. The bottom door 26 selectively covers and closes the bottom opening 24 into the container 12. A lock 28 is coupled to the container 12 and the bottom door 26 wherein the lock 28 selectively secures the bottom door 26 in a closed position 30 closing the bottom opening 24 into the container 12. A key 70 may be used to selectively unlock the lock 28 wherein the bottom door 26 is selectively openable only by use of the key 70.

A top panel 32 is coupled to the top end 16 of the container 12. At least one bill compartment 34 is positioned in the interior space 20 of the container 12. A plurality of dividers 36 extends between the perimeter wall 14 and an interior wall 38 providing a plurality of bill compartments 34 positioned in the interior space 20. Each bill compartment 34 is elongated. Each of a plurality of bill openings 36 extends through the top panel 32. Each bill opening 36 is aligned with an associated one of the bill compartments 34. Each bill opening 36 may be circular wherein the bill opening 36 is configured for receiving a plurality of rolled bills 38. Each bill opening 36 is positioned at a top 40 of the associated bill compartment 34 and is configured for passing the rolled bills 38 through the bill opening 36 into the associated bill compartment 34. A perimeter edge 66 of each bill opening 36 is positioned in spaced relationship to an outer side 68 of the associated bill compartment 34 wherein each bill opening 36 is configured for inhibiting removal of rolled bills 38 from the associated bill compartment 34. Thus, each bill opening 36 is configured for restricting removal of the rolled bills 38 from the associated bill compartment 34 through the bill opening 36 after the rolled bills 38 have expanded.

A card compartment 50 is positioned in the interior space 20 of the container 12. A card opening 52 extends through the top panel 32. The card opening 52 is an elongated slot positioned at a top 54 of the card compartment 50. The card opening 52 is configured for passing a card 56 through the card opening 52 into the card compartment 50. A resilient diaphragm 58 is coupled to and extends across the card opening 52. A slit 60 extends through the diaphragm 58. The slit 60 is configured for snugly receiving the card 56 therethrough when the card 56 is pushed through the card opening 52. The diaphragm 58 is configured to restrict the card 56 from passing through the card opening 52 out of the card compartment 50 to prevent removal of the card 56 through the card opening 52. Thus, the card opening 52 is configured for restricting removal of the card 56 from the card compartment 50 through the card opening 52.

A lid 62 is pivotally coupled to the container 12. The lid 62 selectively covers each bill opening 36 and the card opening 52 when the lid 62 is in a closed position 64. The lid 62 may be free of any lock allowing free access to the bill openings 36 and card opening 52 by pivoting of the lid 62. Each bill compartment 34 may be sized to hold as many as five rolled bills and the card compartment 50 may be sized to hold as many as three cards 56.

In use, rolled bills 38 and cards 56 may be inserted into the container 12 through the top panel 32 for storage. The rolled bills 38 and cards 56 then become effectively inaccessible through the top panel 32. The lock 28 on the bottom door 26 allows a person to restrict access to the interior space 20, and thus removal of the rolled bills 38 and cards 56 until the key 70 is available. Thus, the device 10 allows a person to leave the key 70 at a remote location to where gambling is available. The person may periodically elect to insert winnings into the bill compartments 34 where they become inaccessible and thus prevent the person from putting these resources at immediate risk. The person may further restrict access to additional funds while gambling by placing a credit card, debit card, or identification such as a driver's license required for cashing checks within the card compartment 50. Thus, an initial limit of risk may be determined and taken to a casino or the like. Winnings may be periodically inserted into the container where they are protected from immediate access and risk.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gambling risk management device comprising:

a container having a perimeter wall extending between a top end and a bottom end of said container, said perimeter wall defining an interior space, a bottom edge of said perimeter wall defining a bottom opening into said interior space;

a bottom door coupled to said perimeter wall, said bottom door selectively covering and closing said bottom opening into said container;

a lock coupled to said container and said bottom door wherein said lock selectively secures said bottom door in a closed position closing said bottom opening into said container;

a top panel coupled to said top end of said container;

a bill compartment positioned in said interior space of said container;

a bill opening extending through said top panel, said bill opening being positioned at a top of said bill compartment, said bill opening being configured for passing a bill through said bill opening into said bill compartment, a perimeter edge of said bill opening being positioned in spaced relationship to an outer side of said bill compartment wherein said bill opening is configured for inhibiting removal of a rolled bill from said bill compartment;

a card compartment positioned in said interior space of said container; and a card opening extending through said top panel, said card opening being positioned at a top of said card compartment, said card opening being configured for passing a card through said card opening into said card compartment;

a resilient diaphragm coupled to and extending across said card opening; and a slit extending through said diaphragm, said slit being configured for snugly receiving the card therethrough when the card is pushed through the card opening, said diaphragm being configured to restrict the card from passing through said card opening out of said card compartment.

2. The device of claim 1, further comprising a lid pivotally coupled to said container, said lid selectively covering said bill opening and said card opening when said lid is in a closed position.

3. The device of claim 1, further comprising an interior wall being coupled to said container, said interior wall dividing said bill compartment from said card compartment.

4. The device of claim 3, further comprising:

a plurality of dividers extending between said perimeter wall and said interior wall wherein said bill compartment is one of a plurality of bill compartments positioned in said interior space; and said bill opening being one of a plurality of bill openings, each said bill opening being aligned with an associated one of said bill compartments.

5. The device of claim 4, further comprising:

each said bill compartment being elongated; and each said bill opening being circular wherein said bill opening is configured for receiving a plurality of rolled bills.

6. The device of claim 1, further comprising said card opening being an elongated slot.

7. The device of claim 1, further comprising a key, said key selectively unlocking said lock wherein said bottom door is selectively openable.

8. A gambling risk management device comprising:

a container having a perimeter wall extending between a top end and a bottom end of said container, said perimeter wall defining an interior space, a bottom edge of said perimeter wall defining a bottom opening into said interior space;

a bottom door coupled to said perimeter wall, said bottom door selectively covering and closing said bottom opening into said container;

a lock coupled to said container and said bottom door wherein said lock selectively secures said bottom door in a closed position closing said bottom opening into said container;

a top panel coupled to said top end of said container;

a bill compartment positioned in said interior space of said container;

a plurality of dividers extending between said perimeter wall and said interior wall wherein said bill compartment is one of a plurality of bill compartments positioned in said interior space, each said bill compartment being elongated;

a plurality of bill openings extending through said top panel, each said bill opening being aligned with an associated one of said bill compartments, each said bill opening being circular wherein said bill opening is configured for receiving a plurality of rolled bills, each said bill opening being positioned at a top of said associated bill compartment, each said bill opening being configured for passing the rolled bills through said bill opening into said associated bill compartment;

a card compartment positioned in said interior space of said container; and a card opening extending through said top panel, said card opening being an elongated slot, said card opening being positioned at a top of said card compartment, said card opening being configured for passing a card through said card opening into said card compartment;

a lid pivotally coupled to said container, said lid selectively covering each said bill opening and said card opening when said lid is in a closed position;

an interior wall being coupled to said container, said interior wall dividing said bill compartment from said card compartment;

a perimeter edge of each said bill opening being positioned in spaced relationship to an outer side of said associated bill compartment wherein each said bill opening is configured for inhibiting removal of rolled bills from said associated bill compartment;

a resilient diaphragm coupled to and extending across said card opening;

a slit extending through said diaphragm, said slit being configured for snugly receiving the card therethrough when the card is pushed through the card opening, said diaphragm being configured to restrict the card from passing through said card opening out of said card compartment; and a key, said key selectively unlocking said lock wherein said bottom door is selectively openable.

* * * * *